US011757184B2

(12) United States Patent
Rostomyan

(10) Patent No.: US 11,757,184 B2
(45) **Date of Patent: *Sep. 12, 2023**

(54) SWITCHED COUPLED INDUCTANCE PHASE SHIFT MECHANISM

(71) Applicant: Metawave Corporation, Carlsbad, CA (US)

(72) Inventor: Narek Rostomyan, San Diego, CA (US)

(73) Assignee: Metawave Corporation, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/564,174

(22) Filed: Dec. 28, 2021

(65) Prior Publication Data

US 2022/0123468 A1 Apr. 21, 2022

Related U.S. Application Data

(63) Continuation of application No. 16/747,407, filed on Jan. 20, 2020, now Pat. No. 11,211,704.

(Continued)

(51) Int. Cl.
*H01Q 3/36* (2006.01)
*H01F 21/02* (2006.01)

(52) U.S. Cl.
CPC ..... *H01Q 3/36* (2013.01); *H01F 21/02* (2013.01)

(58) Field of Classification Search
CPC ..... H01Q 3/36; H01F 21/02; H01F 21/12
See application file for complete search history.

(56) References Cited

U.S. PATENT DOCUMENTS 3,768,045 A * 10/1973 Chung ..... H03H 7/20 333/164
4,961,062 A * 10/1990 Wendler ..... H03H 7/20 333/139

(Continued)

OTHER PUBLICATIONS

Amit S. Nagra et al., "Monolithic GaAs Phase Shifter Circuit with Low Insertion Loss and Continuous 0-360 Phase Shift at 20 GHz," IEEE Microwave and Guided Wave Letters, vol. 9, No. 9, No. 1, pp. 31-33, Jan. 1999.

(Continued)

*Primary Examiner* — Lam T Mai

(57) ABSTRACT

Examples disclosed herein relate to a switched coupled inductance phase shift mechanism for beamsteering an antenna array and applied in a radar system or a communication system. The phase shift mechanism includes a variable inductor element configured to toggle between a first inductance state and a second inductance state in response to a first control bit value, and a plurality of variable capacitor elements coupled to the variable inductor element and configured to toggle between a first capacitance state and a second capacitance state in response to a second control bit value. The variable inductor element and the variable capacitor elements collectively produce a first phase shift using the first inductance and capacitance states, and collectively produce a second phase shift using the second inductance and capacitance states, where a target phase shift is produced from a difference between the first and second phase shifts. Other examples disclosed herein relate to an antenna array and a method of phase shifting with switched coupled inductance.

20 Claims, 10 Drawing Sheets

Related U.S. Application Data

(60) Provisional application No. 62/854,290, filed on May 29, 2019.

(56) References Cited

U.S. PATENT DOCUMENTS

| | | | | |
|---|---|---|---|---|
| 5,940,030 | A | 8/1999 | Hampel et al. | |
| 7,250,908 | B2 | 7/2007 | Lee | |
| 7,724,189 | B2 * | 5/2010 | Lee | H01Q 3/38 342/374 |
| 8,179,331 | B1 * | 5/2012 | Sievenpiper | H01P 1/182 343/754 |
| 9,545,923 | B2 | 1/2017 | Casse et al. | |
| 10,205,457 | B1 | 2/2019 | Josefsberg et al. | |
| 11,211,704 | B2 * | 12/2021 | Rostomyan | H01F 21/02 |
| 11,218,203 | B1 * | 1/2022 | Lee | H04B 7/0617 |
| 2002/0186098 | A1 * | 12/2002 | Sayyah | H03H 11/20 333/156 |
| 2005/0007213 | A1 * | 1/2005 | Nakajima | H03H 7/20 333/156 |
| 2010/0315170 | A1 * | 12/2010 | Locascio | H03H 9/25 331/15 |
| 2011/0175789 | A1 | 6/2011 | Lee et al. | |
| 2012/0223787 | A1 * | 9/2012 | Lindenmeier | H01P 1/184 333/139 |
| 2012/0256805 | A1 * | 10/2012 | Orihashi | H01Q 3/30 343/853 |
| 2013/0059553 | A1 * | 3/2013 | Orihashi | H01Q 9/0435 455/126 |
| 2014/0022132 | A1 * | 1/2014 | Badaruzzaman | H01Q 9/14 343/745 |
| 2014/0177686 | A1 * | 6/2014 | Greene | H04B 1/0458 375/219 |
| 2015/0116159 | A1 * | 4/2015 | Chen | H01Q 3/34 343/702 |
| 2016/0011307 | A1 | 1/2016 | Casse et al. | |
| 2016/0013531 | A1 | 1/2016 | Casse et al. | |
| 2016/0087299 | A1 * | 3/2016 | Van Dyke | H01M 8/1004 429/535 |
| 2017/0063342 | A1 * | 3/2017 | Cook | H03H 7/20 |
| 2017/0264322 | A1 * | 9/2017 | Greene | H04B 1/40 |
| 2018/0241122 | A1 * | 8/2018 | Jalali Mazlouman | H01Q 3/36 |

OTHER PUBLICATIONS

A. S. Nagra et al., "Distributed analog phase shifters with low insertion loss," in IEEE Transactions on Microwave Theory and Techniques, vol. 47, No. 9, pp. 1705-1711, Sep. 1999.

Mojtaba Moeini-Fard et al., "Transmit Array Antenna Using Non-uniform Dielectric Layer," Science Publisher Group, Advances in Wireless Communications and Networks, pp. 23-28, 2017.

H. Peng et al., "Slotted substrate integrated waveguide phase shifter," 2016 IEEE Information Technology, Networking, Electronic and Automation Control Conference, pp. 1036-1039, 2016.

C. Ding et al., "A reconfigurable defected microstrip structure for applications in phase shifter," The 8th European Conference on Antennas and Propagation (EuCAP 2014), pp. 2342-2346, 2014.

E.A. Firouzjaei, "mm-Wave Phase Shifters and Switches," Technical Report No. UCB/EECS-2010-163, Electrical Engineering and Computer Sciences, University of California at Berkeley, Berkeley, CA, USA, Dec. 2010.

Y. J. Guo et al., "Low-cost beamforming employing reconfigurable antennas," 2014 International Workshop on Antenna Technology: Small Antennas, Novel EM Structures and Materials, and Applications (iWAT), Sydney, Australia, pp. 155-158, Mar. 2014.

B. Biglarbegian et al., "Millimeter-Wave Reflective-Type Phase Shifter in CMOS Technology," in IEEE Microwave and Wireless Components Letters, vol. 19, No. 9, pp. 560-562, Sep. 2009.

Y. Yu et al., "A 60 GHz Digitally Controlled Phase Shifter in CMOS," European Solid State Circuits Conference, 34th (ESSCIRC2008), Proceedings Edinburgh, UK, pp. 250-253, Jan. 2008.

L. Boccia et al., "Multilayer Antenna-Filter Antenna for Beam-Steering Transmit-Array Applications," in IEEE Transactions on Microwave Theory and Techniques, vol. 60, No. 7, pp. 2287-2300, Jul. 2012.

J. Reis, et al. "Two-Dimensional Transmitarray Beamsteering Using Stacked Tunable Metamaterials," Loughborough Antennas & Propagation Conference, Loughborough, UK, pp. 495-499, Nov. 2014.

E. E. Westerfield, "A Dynamic Phase-Difference Measurements System," APL Technical Digest, pp. 13-16, Nov.-Dec. 1963.

* cited by examiner

SWITCHED COUPLED INDUCTANCE PHASE SHIFT MECHANISM

CROSS-REFERENCE TO RELATED APPLICATIONS

This application claims priority from U.S. Non-Provisional application Ser. No. 16/747,407, titled "Switched Coupled Inductance Phase Shift Mechanism," filed on Jan. 20, 2020, and incorporated herein by reference in its entirety; and U.S. Provisional Application No. 62/854,290, titled "ANTENNA HAVING COUPLED LINE SHIFT MECHANISM AND CONTROL THEREFOR," filed on May 29, 2019, and incorporated herein by reference in its entirety.

BACKGROUND

Wireless systems operate over a range of frequencies. Each frequency range has its own requirements for operation with desired performance. For example, millimeter wavelength applications have emerged to address the need for higher bandwidth and data rates. The millimeter wavelength spectrum covers frequencies between 30 GHz and 300 GHz and is able to reach data rates of 10 Gbits/s or more with wavelengths in the 1 to 10 mm range. The shorter wavelengths have distinct advantages, including better resolution, high frequency reuse and directed beamforming that are critical in wireless communications and autonomous driving applications. The shorter wavelengths are, however, susceptible to high atmospheric attenuation and have a limited range (just over a kilometer).

In many of these applications, phase shifters are needed to achieve a full range of phase shifts to direct beams to desired directions. Designing millimeter wave phase shifters is challenging as losses must be minimized in miniaturized circuits while providing phase shifts anywhere from 0° to 36°. The circuits and systems designed for one frequency may perform poorly at other frequencies, such as with the introduction of losses, parasitic effects, and so forth.

BRIEF DESCRIPTION OF THE DRAWINGS

The present application may be more fully appreciated in connection with the following detailed description taken in conjunction with the accompanying drawings, which are not drawn to scale, in which like reference characters refer to like parts throughout, and in which.

DETAILED DESCRIPTION

Figure 1:
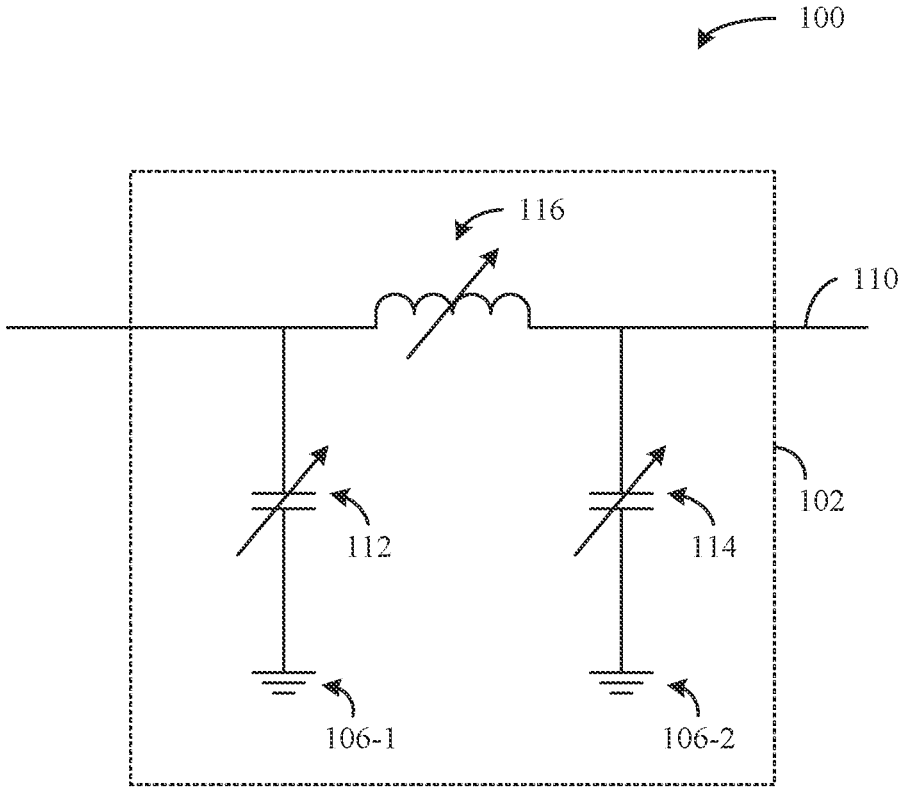
FIG. 1 illustrates a schematic diagram of an example of a phase shift element, according to implementations of the subject technology.

Examples disclosed herein provide methods and apparatuses to enable reliable, accurate propagation of electromagnetic waves over ranges of operation and for a variety of applications. Antenna systems receive signals for transmission over the air, prepare those signals, distribute the signals among various radiating elements and respond to return signals, reflections and communication signals received at such systems. The signal to be transmitted is provided from a signal source to radiating elements by propagation through feed lines. Such feed lines, referred to herein as waveguides and/or transmission lines, are commonly used in wireless devices to provide signal processing. In most systems, the feed lines are configured and designed to operate at a working frequency to steer the beam for transmission at a variety of angles.

It is to be understood that for transmission of a signal, propagation flows from the signal source through a phase shifter, which adjusts the phase of one or more radiating elements in an antenna array to direct the radiation beam. The waveform of the transmitted signal may be described as:

$$s(t)=A(t)\cdot\sin[2\pi f(t)\sim t+\varphi(t)] \quad \text{Eq. (1)}$$

where A(t) is the amplitude modulation, f(t) is the frequency of the signal, and φ(t) is the phase of the signal. The receive operation is similar for an antenna system, where signals are received at the radiating elements of an antenna array and then processed to extract the information in the signals. Such information may be derived from the analog signal directly, such as with Frequency-Modulated Continuous Waveform (FMCW) signals in radar, or may be digital information embedded in the transmission signal.

The present disclosure is described in terms of both receive and transmit operation. For transmit operation, phase shifters create a directed radiation beam or beam form, which is referred to as beam-steering of the transmitted signals. Transmit phase-shifting is for beam-steering of a system-generated signal to be sent in a specific direction.

For receive operation, the phase shifters create phase differentials between radiating elements to compensate for the time delay of received signals between radiating elements due to spatial configurations. Receive phase-shifting, also referred to as analog beamforming, combines the received signals for aligning echoes of transmitted signals received to identify the location, or position of a detected object.

While the phase shifters may operate in a similar manner and may include similar mechanisms and configurations, the purpose of each is specific to the direction of the signals with respect to the antenna.

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, the subject technology is not limited to the specific details set forth herein and may be practiced using one or more implementations. In one or more instances, structures and components are shown in block diagram form in order to avoid obscuring the concepts of the subject technology. In other instances, well-known methods and structures may not be described in detail to avoid unnecessarily obscuring the description of the examples. Also, the examples may be used in combination with each other.

FIG. 1 illustrates a schematic diagram of an example of a phase shift element 100, according to implementations of the subject technology. The phase shift element 100 includes a lumped circuit 102. The lumped circuit 102 may be coupled to a transmission line 110. The lumped circuit 102 includes variable capacitors 112 and 114 and a variable inductor 116. The variable capacitor 112 is coupled to a first terminal of the variable inductor 116 and to a ground terminal 106-1. The variable capacitor 114 is coupled to a second terminal of the variable inductor 116 and to a ground terminal 106-2. In this respect, the variable capacitors 112 and 114 are coupled in series. The variable inductor 116 is coupled in series with the transmission line 110.

In the present example, the lumped circuit 102 may take on two configurations using a switched coupled inductance and switched capacitors, where a first configuration has the self-inductance of the variable inductor 116 and the capacitance of the variable capacitors 12 and 114 set to relative high values and a second configuration has the total inductance of the variable inductor 116 and the capacitance of the variable capacitors 112 and 114 set to relative low values. The configurations are dependent on the state of a corresponding phase shift bit applied to the switched coupled inductance and the switched capacitors.

The variable capacitors 112 and 114 have the same capacitance value in some implementations, or may have different capacitance values in other implementations. As these are variable passive components, the phase shift element 100 can maintain an approximately constant effective impedance at its output while producing a target phase shift value.

Figure 2A:
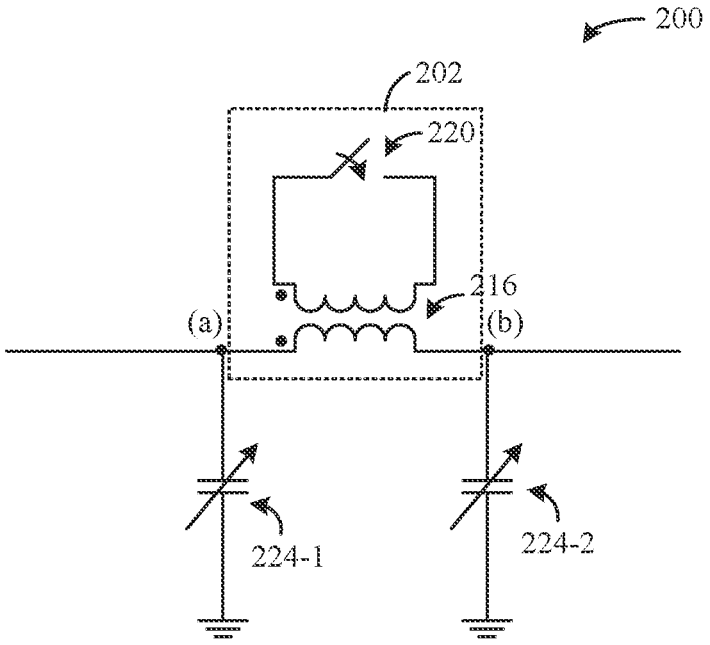
FIG. 2A illustrates a schematic diagram of a phase shift element with a first transformer configuration, according to implementations of the subject technology.

FIG. 2A illustrates a schematic diagram of a phase shift element 200 with a first transformer configuration, according to implementations of the subject technology. The phase shift element 200 includes a switched transformer 202 and variable capacitors 224-1 and 224-2. The switched transformer 202 includes a transformer 216 and a switch 220. The variable capacitor 224-1 is coupled to a first terminal of the primary winding of the transformer 216 at a first node (depicted as "(a)") and to ground. The variable capacitor 224-2 is coupled to a second terminal of the primary winding of the transformer 216 at a second node (depicted as "(b)") and to ground. In some implementations, the primary and secondary windings of the transformer 216 are in phase as denoted by the dots at a same end of the windings. The secondary winding of the transformer 216 is coupled directly to the switch 220. The phase shift element 200 is, or includes at least a portion of, the phase shift element 100 of FIG. 1. In some implementations, the variable inductor 116 of FIG. 1 is represented as, or at least a portion of, the switched transformer 202. In this respect, the primary winding of the transformer 216 may correspond to the variable inductor 116. In some aspects, depending on the state of the switch 220, the total inductance looking into the primary winding may vary between relative low and high inductance values.

Figure 2B:
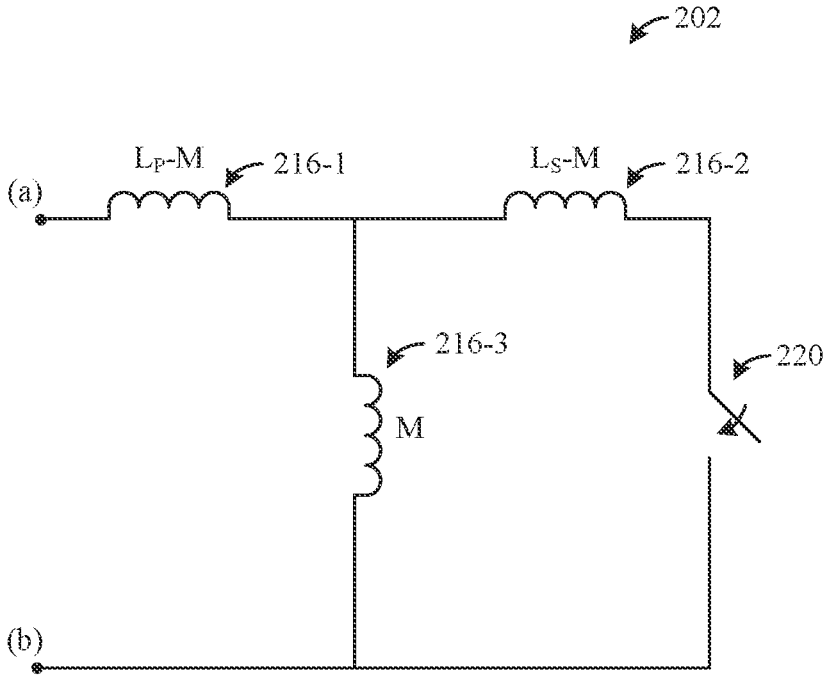
FIG. 2B conceptually illustrates an equivalent circuit of the switched transformer of FIG. 2A, according to implementations of the subject technology.

FIG. 2B conceptually illustrates an equivalent circuit of the switched transformer 202 of FIG. 2A, according to implementations of the subject technology. Referring back to FIG. 2A, the switched transformer 202 includes the transformer 216 and the switch 220, where the transformer 216 includes primary and secondary windings. In the equivalent circuit of FIG. 2B, $L_P$ corresponds to the primary winding self-inductance and $L_S$ corresponds to the second winding self-inductance. The mutual inductance formed between the primary and secondary windings is represented as a third inductor 216-3 coupled to a node between the inductors 216-1 and 216-2, and to the first terminal (depicted as "(a)"). The switch 220 is directly coupled to the inductor 216-2 and to the second terminal (depicted as "(b)"), which corresponds to, at least a portion of, the circuit topology of the switched transformer 202. The inductance of the inductor 216-3 is denoted as M to represent the mutual inductance between the coupled inductors 216-1 and 216-2, whereas the inductance of the inductor 216-1 is denoted as $L_S$-M and the inductance of the inductor 216-2 is denoted as $L_P$-M. In some aspects, the coupling coefficient, k, is expressed as:

$$k = \frac{M}{\sqrt{L_P L_S}}. \quad \text{Eq. (2)}$$

In operation, when the switch 220 is on (or closed), current is drawn through the inductor 216-2, so the current is drawn through a parallel connection of the inductor 216-2 with the inductor 216-3, and through a series connection of the two parallel inductors (e.g., 216-2 and 216-3) with the inductor 216-1 for a total inductance that represents the low state (e.g., $L_L$). The total inductance in the low state can be expressed as:

$$L_S + M - \frac{M^2}{L_P}. \quad \text{Eq. (3)}$$

When the switch 220 is off (or open), no current is drawn through the inductor 216-2, so current is drawn through a series connection of the inductor 216-3 and the inductor 216-1 for a total inductance that represents the high state (e.g., $L_H$) that is equivalent to $L_P$. In this respect, when the switch 220 is open, the total inductance corresponds to a high inductance (denoted as $L_H$), and when the switch 220 is closed, the total inductance corresponds to a low inductance (denoted as $L_L$).

Figure 2D:
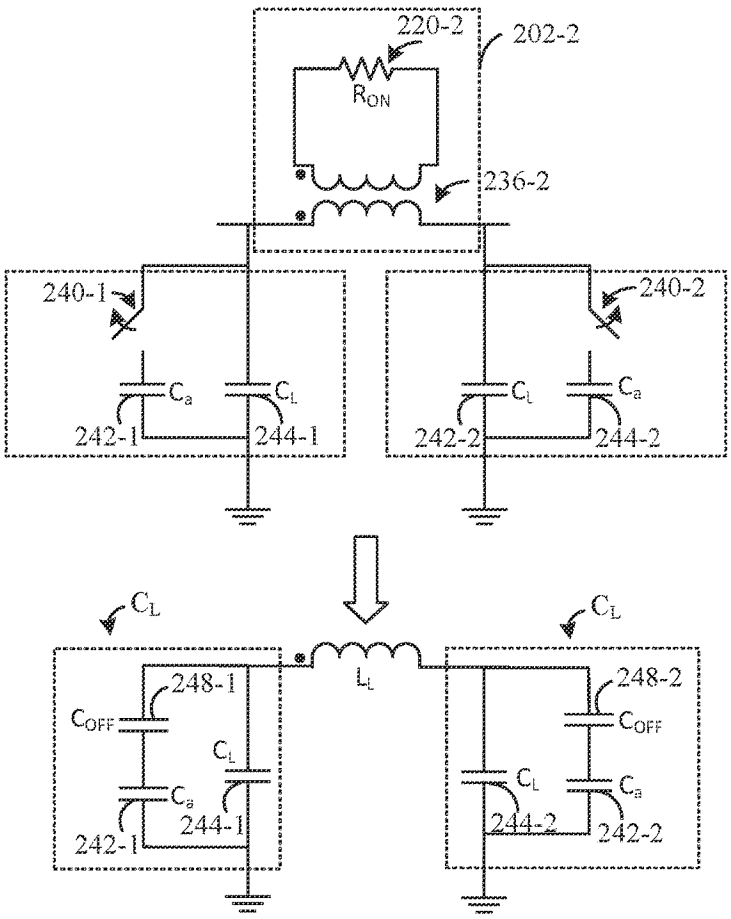
FIGS. 2C and 2D conceptually illustrates operation of the phase shift element of FIG. 2A with a first variable capacitor configuration, according to implementations of the subject technology.
Figure 2C:
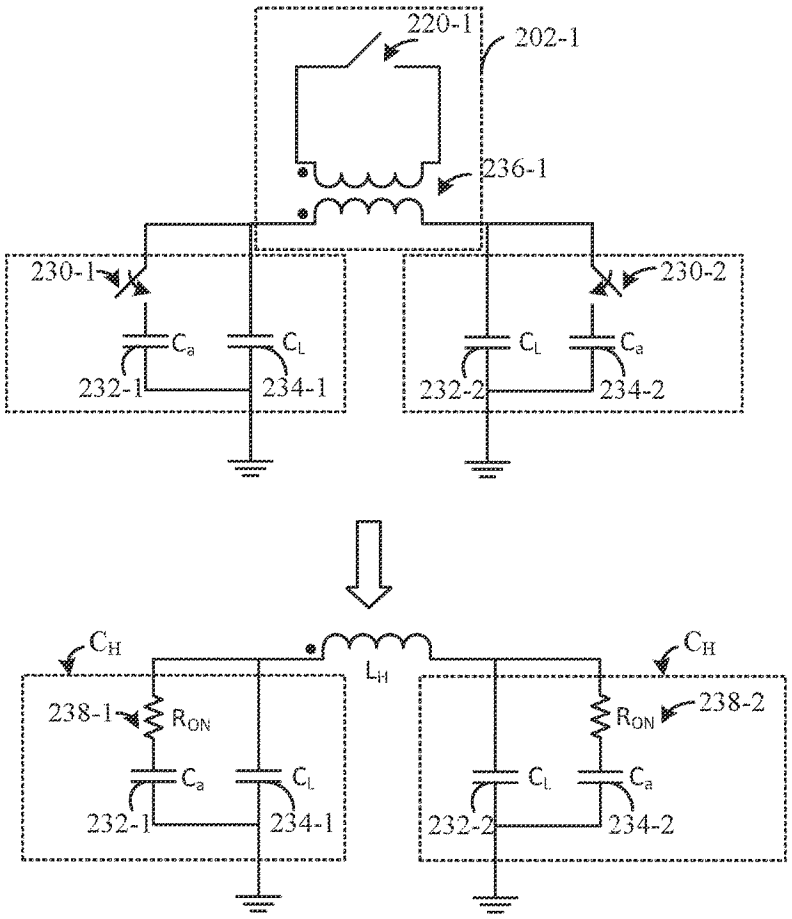

FIG. 2C conceptually illustrates operation of the phase shift element 200 of FIG. 2A with a first variable capacitor configuration in a high state, according to implementations of the subject technology. In FIG. 2C, the phase shift element 200 includes a switch 220-1 and a transformer 236-1. The first variable capacitor configuration includes capacitors 232-1 and 234-1 and switch 230-1 to collectively correspond to the variable capacitor 112 of FIG. 1A. The switch 230-1 is coupled in series with the capacitor 232-1, which are coupled in parallel to the capacitor 234-1. Similarly, the first variable capacitor configuration also includes capacitors 232-2 and 234-2 and switch 230-2 to collectively correspond to the variable capacitor 114 of FIG. 1A. The switch 230-2 is coupled in series with the capacitor 232-2, which are coupled in parallel to the capacitor 234-2. The switches 230-1 and 230-2 are coupled to operate opposite to that of the switch 220-1. For example, when the switch 220-1 is open, the switches 230-1 and 230-2 are closed (or on). Conversely, when the switch 220-1 is closed, the switches 230-1 and 230-2 are opened (or off).

In some implementations, the switches 230-1 and 230-2 when closed, represent an 'ON' resistance 238-1 and 238-2 (denoted as Rory), respectively. The resistances 238-1 and 238-2 correspond to the transistor impedance when powered on. In some implementations, the switches 230-1 and 230-1 include one or more transistors (e.g., NMOS, PMOS, BJT, etc.). In order to keep the transistor impedance significantly small at working frequencies that correspond to millimeter wavelengths (e.g., 77 GHz), the size of the transistors is relatively large (e.g., where W>>L). In some aspects, the transistor impedance can be negligible.

In operation, when the switch 220-1 is open, no current is drawn through the secondary winding of the transformer 236-1, which in turn causes the self-inductance of the primary winding to increase to a high inductance (e.g., $L_H$). The switches 230-1 and 230-2 are closed (relative to the open switch 220-1), which in turn causes the capacitors 232-1 and 234-1 to electrically couple in parallel to one another on one branch to ground and the capacitors 232-2 and 234-2 to electrically couple in parallel to one another on a different branch to ground. In some implementations, the capacitors 232-1 and 234-2 produce a capacitance that corresponds to a predetermined difference between the high capacitance (e.g., $C_H$) and a low capacitance (e.g., $C_L$). The capacitors 232-1, 234-1 and 232-2, 234-2 have capacitance values that collectively produce a high capacitance (e.g., $C_H$) on respective branches given that the self-inductance of the primary winding of the transformer 216 is relatively high.

FIG. 2D conceptually illustrates operation of the phase shift element 200 of FIG. 2A with the first variable capacitor configuration in a low state, according to implementations of the subject technology. In FIG. 2D, the phase shift element 200 includes a switch 220-2 and a transformer 236-2. The first variable capacitor configuration includes capacitors 242-1 and 244-1 and switch 240-1 to collectively correspond to the variable capacitor 112 of FIG. 1A. The switch 240-1 is coupled in series with the capacitor 242-1, which are coupled in parallel to the capacitor 244-1. Similarly, the first variable capacitor configuration also includes capacitors 242-2 and 244-2 and switch 240-2 to collectively correspond to the variable capacitor 114 of FIG. 1A. The switch 240-2 is coupled in series with the capacitor 242-2, which are coupled in parallel to the capacitor 244-2. The switches 240-1 and 240-2 are coupled to operate opposite to that of the switch 220-2. For example, when the switch 220-2 is closed, the switches 240-1 and 240-2 are opened (or off).

In some implementations, the switch 220-2 when closed, represents an 'ON' resistance (denoted as Rory). In order to keep the transistor impedance significantly small at working frequencies that correspond to millimeter wavelengths (e.g., 77 GHz), the size of the transistors is relatively large (e.g., where W>>L). In some aspects, the transistor impedance across the switch 220-2 can be negligible.

In operation, when the switch 220-2 is closed, current is drawn through the secondary winding of the transformer 236-2, which in turn produces a magnetic flux across to the primary winding of the transformer 236-2. As the current increases through the primary winding, the impedance of the primary winding decreases, which in turn causes the self-inductance of the primary winding to decrease to a low inductance (e.g., $L_L$). In the off state, there is a leakage capacitance across the switches 240-1 and 240-2 (denoted as $C_{OFF}$ 248-1 and 248-2, respectively). The switches 240-1 and 240-2 are opened (relative to the closed switch 220-2), which in turn causes the capacitors 242-1 and 248-1 to electrically couple in series and collectively couple in parallel to capacitor 244-1, while the capacitors 242-2 and 248-2 are electrically coupled in series and collectively couple in parallel to capacitor 244-2. The switches 240-1 and 240-2 are designed to a particular size such that the transistor impedance in the on state is relatively low while the leakage capacitance in the off state is also relatively low (e.g., at a median value between the high and low capacitances). In this respect, the capacitors 242-1, 244-1, 248-1 and 242-2, 244-2, 248-2 have capacitance values that collectively produce a low capacitance (e.g., $C_L$) in correspondence to the self-inductance of the primary winding of the transformer 216 being relatively low.

By calculating the low and high inductances in the respective switch states, the phase shift element 200 can produce a target phase shift value, $\varphi_{DESIRED}$, which is equivalent to the difference between $\varphi_H$ and $\varphi_L$ (or $\varphi_H-\varphi_L$). In some implementations, the phase shift for the high state (e.g., $\varphi_H$) is proportional to $\sqrt{L_H C_H}$. In some aspects, the inductance in the high state as a function of the corresponding phase shift can be expressed as:

$$L_H = Z_o^{\sin(\varphi_H)}/\omega_o, \quad \text{Eq. (4)}$$

where $\omega_o$ is the radial frequency, $Z_o$ is the effective impedance, and $\varphi_H$ is the phase shift in the high state. In some aspects, the capacitance in the high state as a function of the corresponding phase shift can be expressed as:

$$C_H = \frac{1-\cos(\varphi_H)}{\omega_o z_o \sin(\varphi_H)}. \quad \text{Eq. (5)}$$

In some implementations, the phase shift for the low state (e.g., $\varphi_L$) is proportional to $\sqrt{L_L C_L}$. In some aspects, the inductance in the low state as a function of the corresponding phase shift can be expressed as:

$$L_L = Z_o^{\sin(\varphi_L)}/\omega_o, \quad \text{Eq. (6)}$$

while the capacitance in the low state as a function of the corresponding phase shift can be expressed as:

$$C_L = \frac{1-\cos(\varphi_L)}{\omega_o z_o \sin(\varphi_L)}. \quad \text{Eq. (7)}$$

In some aspects, the relationship between the high and low capacitances is expressed as:

$$C_H = n^* C_L, \quad \text{Eq. (8)}$$

where n is a predetermined factor. The same predetermined factor can be used to determine the relationship between high and low inductances, where $L_H = n*L_L$.

Figure 2F:
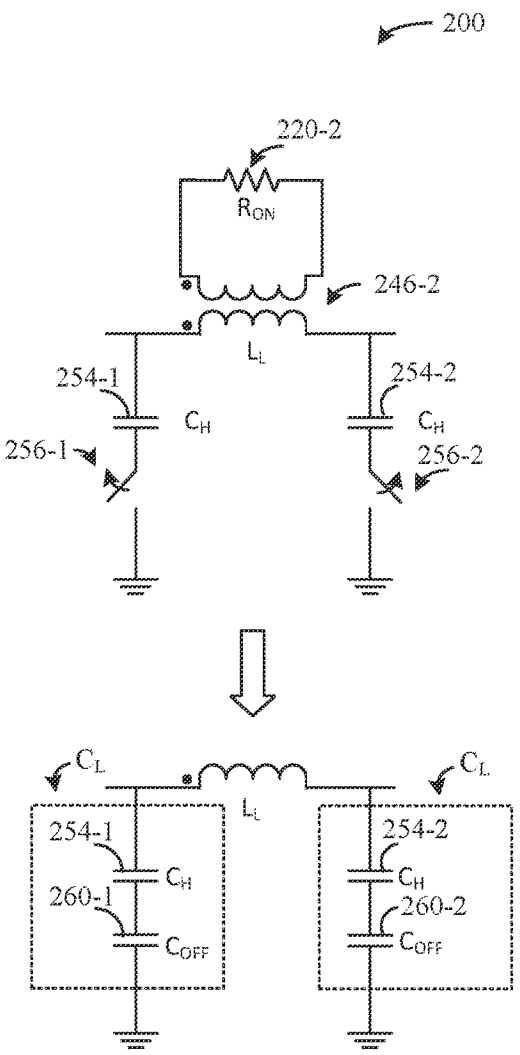
FIGS. 2E and 2F conceptually illustrates operation of the phase shift element of FIG. 2A with a second variable capacitor configuration, according to implementations of the subject technology.
Figure 2E:
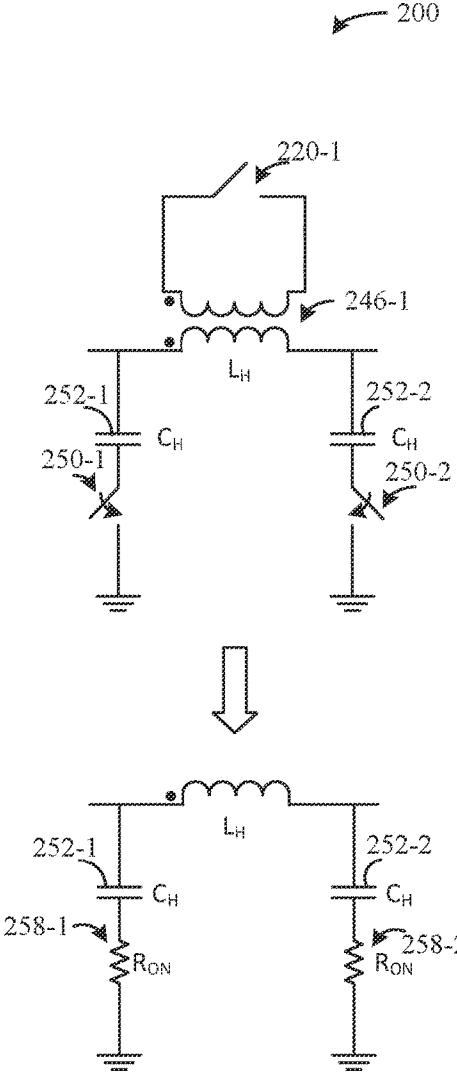

FIG. 2E conceptually illustrates operation of the phase shift element 200 of FIG. 2A with a second variable capacitor configuration in the high state, according to implementations of the subject technology. In FIG. 2E, the phase shift element 200 includes a switch 220-1 and a transformer 246-1. The second variable capacitor configuration includes capacitor 252-1 and switch 250-1 to collectively correspond to the variable capacitor 112 of FIG. 1A. The switch 250-1 is coupled in series with the capacitor 252-1. Similarly, the second variable capacitor configuration also includes capacitor 252-2 and switch 250-2 to collectively correspond to the variable capacitor 114 of FIG. 1A. The switch 250-2 is coupled in series with the capacitor 252-2. The switches 250-1 and 250-2 are coupled to operate opposite to that of the switch 220-1. For example, when the switch 220-1 is open, the switches 250-1 and 250-2 are closed (or on).

In some implementations, the switches 250-1 and 250-2 when closed, represent an 'ON' resistance 238-1 and 238-2 (denoted as Rory), respectively. The resistances 258-1 and 258-2 correspond to the transistor impedance when powered on. In order to keep the transistor impedance significantly small at working frequencies that correspond to millimeter wavelengths (e.g., 77 GHz), the size of the transistors is relatively large (e.g., where W>>L). In some aspects, the transistor impedance of resistances 258-1 and 258-2 can be negligible.

In operation, when the switch 220-1 is open, no current is drawn through the secondary winding of the transformer 246-1, which in turn causes the self-inductance of the primary winding to increase to a high inductance (e.g., $L_H$). The switches 250-1 and 250-2 are closed (relative to the open switch 220-1), thus drawing current through the capacitors 252-1 and 252-2. The total capacitance on each branch corresponds to the capacitance value of capacitors 252-1 and 252-2, respectively, in view of the transistor impedances being negligible. In this respect, each branch produces a high capacitance (e.g., $C_H$) given that the self-inductance of the primary winding of the transformer 216 is relatively high.

FIG. 2F conceptually illustrates operation of the phase shift element of FIG. 2A with the second variable capacitor configuration in the low state, according to implementations of the subject technology. In FIG. 2E, the phase shift element 200 includes a switch 220-2 and a transformer 246-2. The second variable capacitor configuration includes capacitor 254-1 and switch 256-1 to collectively correspond to the variable capacitor 112 of FIG. 1A. The switch 256-1 is coupled in series with the capacitor 254-1. Similarly, the second variable capacitor configuration also includes capacitor 254-2 and switch 256-2 to collectively correspond to the variable capacitor 114 of FIG. 1A. The switch 256-2 is coupled in series with the capacitor 254-2. The switches 256-1 and 256-2 are coupled to operate opposite to that of the switch 220-2. For example, when the switch 220-2 is closed, the switches 256-1 and 256-2 are opened (or off).

In some implementations, the switch 220-2 when closed, represents an 'ON' resistance (denoted as Rory). In order to keep the transistor impedance significantly small at working frequencies that correspond to millimeter wavelengths (e.g., 77 GHz), the size of the transistors is relatively large (e.g., where W>>L). In some aspects, the transistor impedance across the switch 220-2 can be negligible.

In operation, when the switch 220-2 is closed, current is drawn through the secondary winding of the transformer 246-2, which in turn produces a magnetic flux across to the primary winding of the transformer 246-2. As the current increases through the primary winding, the impedance of the primary winding decreases, which in turn causes the self-inductance of the primary winding to decrease to a low inductance (e.g., $L_L$). In the off state of the switches 256-1 and 256-2, there is a leakage capacitance across the switches 256-1 and 256-2 (denoted as $C_{OFF}$ 260-1 and 260-2, respectively). The switches 256-1 and 256-2 are opened (relative to the closed switch 220-2), which in turn causes the capacitors 254-1 and 260-1 to electrically couple in series, while the capacitors 254-2 and 260-2 are electrically coupled in series. The switches 256-1 and 256-2 are designed to a particular size such that the transistor impedance in the on state is relatively low while the leakage capacitance in the off state is also relatively low (e.g., at a median value between the high and low capacitances). In this respect, the summation of capacitances of the capacitors 254-1, 260-1 and 254-2, 260-2

$$\left(\text{e.g., } \frac{1}{C_H} + \frac{1}{C_{OFF}} = \frac{1}{C_L}\right)$$

collectively produce a low capacitance (e.g., $C_L$) on respective branches in correspondence to the self-inductance of the primary winding of the transformer 216 being relatively low.

Figure 3A:
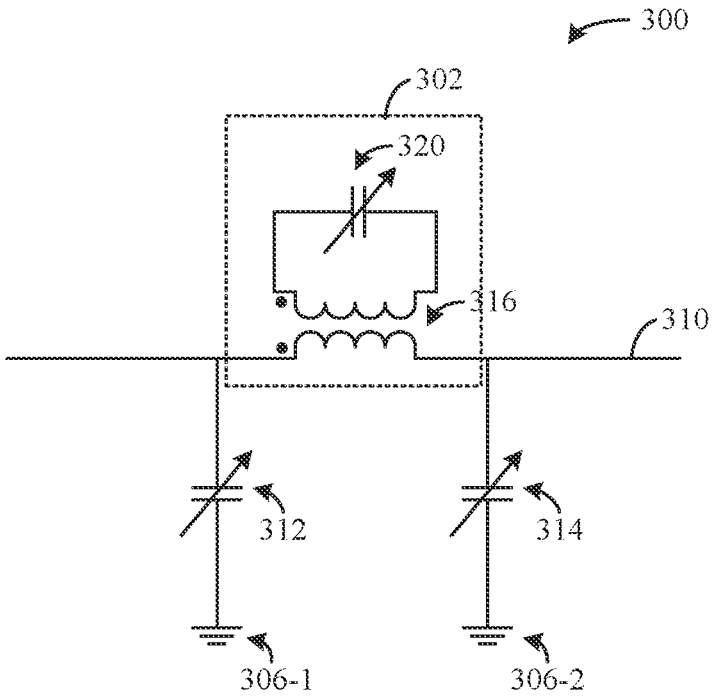
FIG. 3A illustrates a schematic diagram of a phase shift element with a second variable inductor configuration, according to implementations of the subject technology.

FIG. 3A illustrates a schematic diagram of a phase shift element 300 with a second variable inductor configuration, according to implementations of the subject technology. The phase shift element 300 includes a switched transformer 302 and variable capacitors 312 and 314. The switched transformer 302 includes a transformer 316 and a variable capacitor 320. The variable capacitor 312 is coupled to a first terminal of the primary winding of the transformer 316 and to ground. The variable capacitor 314 is coupled to a second terminal of the primary winding of the transformer 316 and to ground. In some implementations, the primary and secondary windings of the transformer 316 are in phase as denoted by the dots at a same end of the windings. The secondary winding of the transformer 316 is coupled directly to the variable capacitor 320. The phase shift element 300 is, or includes at least a portion of, the phase shift element 100 of FIG. 1. In some implementations, the variable inductor 116 of FIG. 1 is represented as, or at least a portion of, the switched transformer 302. In this respect, the primary winding of the transformer 316 may correspond to the variable inductor 116. In some aspects, depending on the capacitive state of the variable capacitance 320, the effective inductance looking into the primary winding may vary between relative low and high inductance values at the center frequency of operation. In some implementations, the variable capacitor 320 includes one or more varactors or variable voltage capacitors. In some implementations, the variable capacitor 320 includes a switched capacitor bank.

Figure 3B:
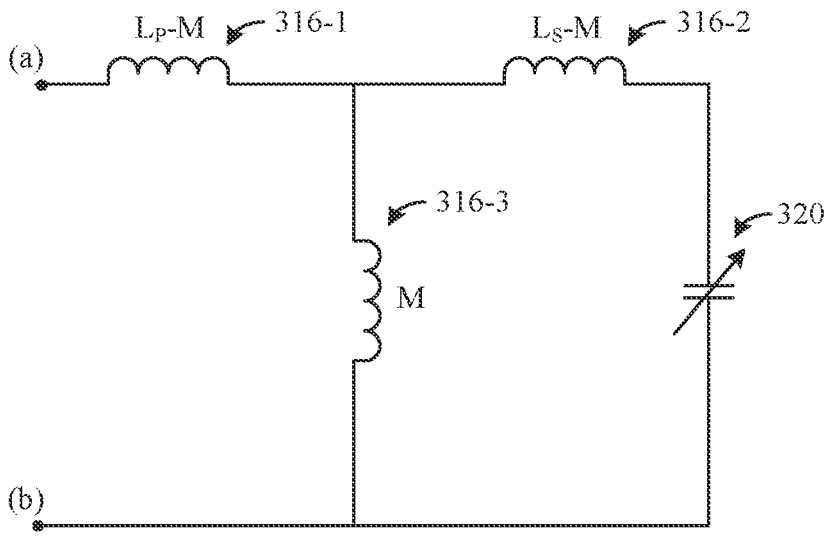
FIG. 3B conceptually illustrates an equivalent circuit of the phase shift element of FIG. 3A, according to implementations of the subject technology.

FIG. 3B conceptually illustrates an equivalent circuit of the phase shift element of FIG. 3A, according to implementations of the subject technology. Referring back to FIG. 3A, the switched transformer 302 includes the transformer 316 and the switch 320, where the transformer 316 includes primary and secondary windings. In the equivalent circuit of FIG. 3B, $L_P$ corresponds to the primary winding self-inductance and $L_S$ corresponds to the second winding self-inductance. The mutual inductance formed between the primary and secondary windings is represented as a third inductor 316-3 coupled to a node between the inductors

316-1 and 316-2, and to a first terminal (depicted as "(a)"). The variable capacitor 320 is directly coupled to the inductor 316-2 and to a second terminal (depicted as "(b)"), which corresponds to, at least a portion of, the circuit topology of the switched transformer 302. In some aspects, the variable capacitor 320 transitions into a first capacitive state when it is applied with a first voltage (or capacitive state of the variable capacitor 320), and transitions into a second capacitive state when it is applied with a second voltage different from the first voltage (or the capacitive state). In this respect, when the variable capacitor 320 is in a first capacitive state, the total inductance at the center frequency of operation corresponds to a high inductance (denoted as $L_H$), and when the variable capacitor 320 is in a second capacitive state, the total inductance at the center frequency of operation corresponds to a low inductance (denoted as $L_L$).

Figure 4A:
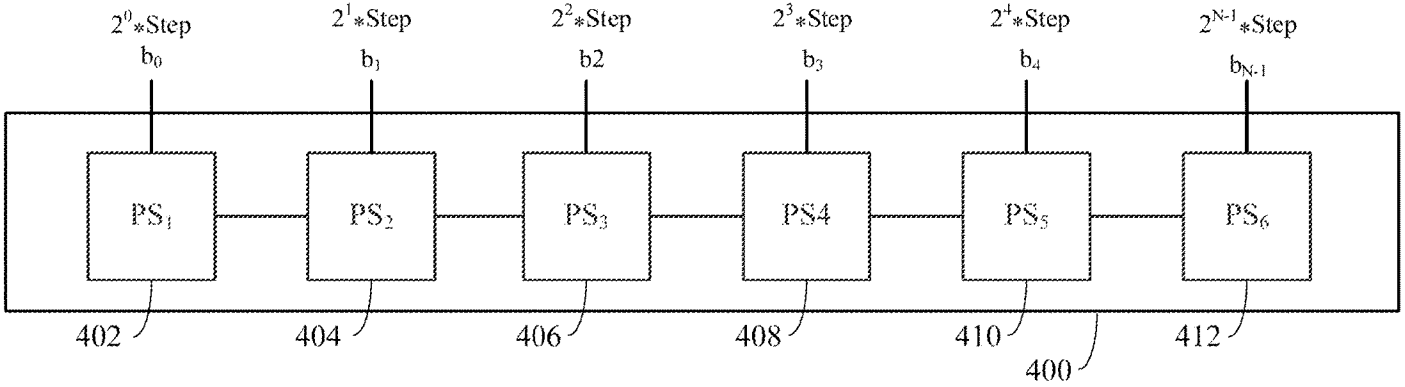
FIG. 4A conceptually illustrates a phase shift module having series-connected phase shift elements, according to implementations of the subject technology.

FIG. 4A conceptually illustrates a phase shift module 400 having series-connected phase shift elements, according to implementations of the subject technology. The phase shift module 400 includes six phase shift elements 402 (depicted as $PS_1$), 404 (depicted as $PS_2$), 406 (depicted as $PS_3$), 408 (depicted as $PS_4$), 410 (depicted as $PS_5$) and 412 (depicted as $PS_6$). The number of phase shift elements in the phase shift module 400 can be higher or lower depending on a desired quantization (or resolution). Although the phase shift elements 402-412 are coupled in series; alternate examples may incorporate a variety of configurations to achieve a range of phase shifts.

In some implementations, the phase shift module 400 represents a multi-bit phase shifter that can phase shift a signal travelling through a transmission line from 0° to 360° in various phase shift steps. Each of the phase shift elements 402-412 is coupled to a respective bit value of a phase shift control vector (e.g., $b_0$:$b_{N-1}$), where each phase shift element produces a phase shift value that corresponds to $2^n$*Step, where Step is expressed as $$\frac{360^\circ}{2^N},$$

n is in a range of 0 to N−1, and where N is the number of phase shift bits. For example, for a 6-bit phase shift vector, each step is equivalent to 5.625°. In this respect, the phase shift element 402 produces a phase shift value equivalent to 5.625°, the phase shift element 404 produces a phase shift value equivalent to 11.25°, the phase shift element 406 produces a phase shift value equivalent to 22.5°, the phase shift element 408 produces a phase shift value equivalent to 45°, the phase shift element 410 produces a phase shift value equivalent to 90° and the phase shift element 412 produces a phase shift value equivalent to 180°. Because of the series connection of the phase shift elements 402-412, the total phase shift in the configuration of FIG. 4B can be in the range of 0° to 360° in 5.625° increments (or steps). In some implementations, the phase shift element 402 is coupled to the least-significant bit of the phase shift bit vector and the phase shift element 412 is coupled to the most-significant bit of the phase shift bit vector.

Figure 4B:
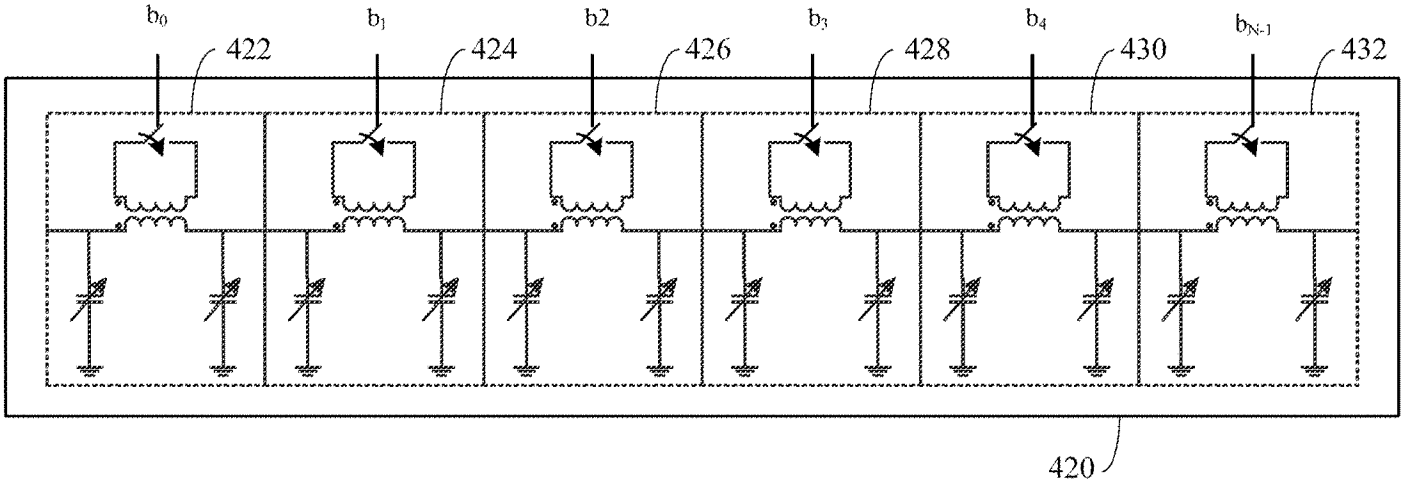
FIG. 4B illustrates a schematic diagram of the series-connected phase shift elements, according to implementations of the subject technology.

FIG. 4B illustrates a schematic diagram of a phase shift module 420 with the series-connected phase shift elements, according to implementations of the subject technology. The phase shift module 420 includes phase shift elements having respective phase shift circuits 422-432. Each of the phase shift circuits 422-432 is similar in structure to the phase shift element 200 of FIG. 2C; however, the structure may also correspond to the circuit topology of the phase shift element 300 of FIG. 3A without departing from the scope of the present disclosure.

In each of the phase shift circuits 422-432, the switch coupled to the transformer is coupled to a respective phase shift bit value, where the parity of the phase shift bit value controls the state of the switch. For example, a logical high signal (or '1') may close (or turn on) the switch, whereas a logical low signal (or '0') may open (or turn off) the switch. The bit values between the switches and the variable capacitors are opposite of each other, and therefore, cause the switches and variable capacitors to operate differently. In some aspects, one or more of the phase shift circuits 422-432 may be toggled to transition into a high state (or high inductance state and high capacitance state) while the remaining phase shift circuits transition into a low state (or low inductance state and low capacitance state). As discussed in FIGS. 2C-2F, a phase shift bit value can cause the inductor and capacitors to toggle between high and low L and C states, respectively, within a corresponding phase shift circuit. As such, each phase shift circuit produces a resultant phase shift from the difference between a first phase shift at the high state and a second phase shift at the low state. The phase shift circuits 422-432 are provided in sequence such that their constructive sum can achieve a desired phase shift.

Figure 5:
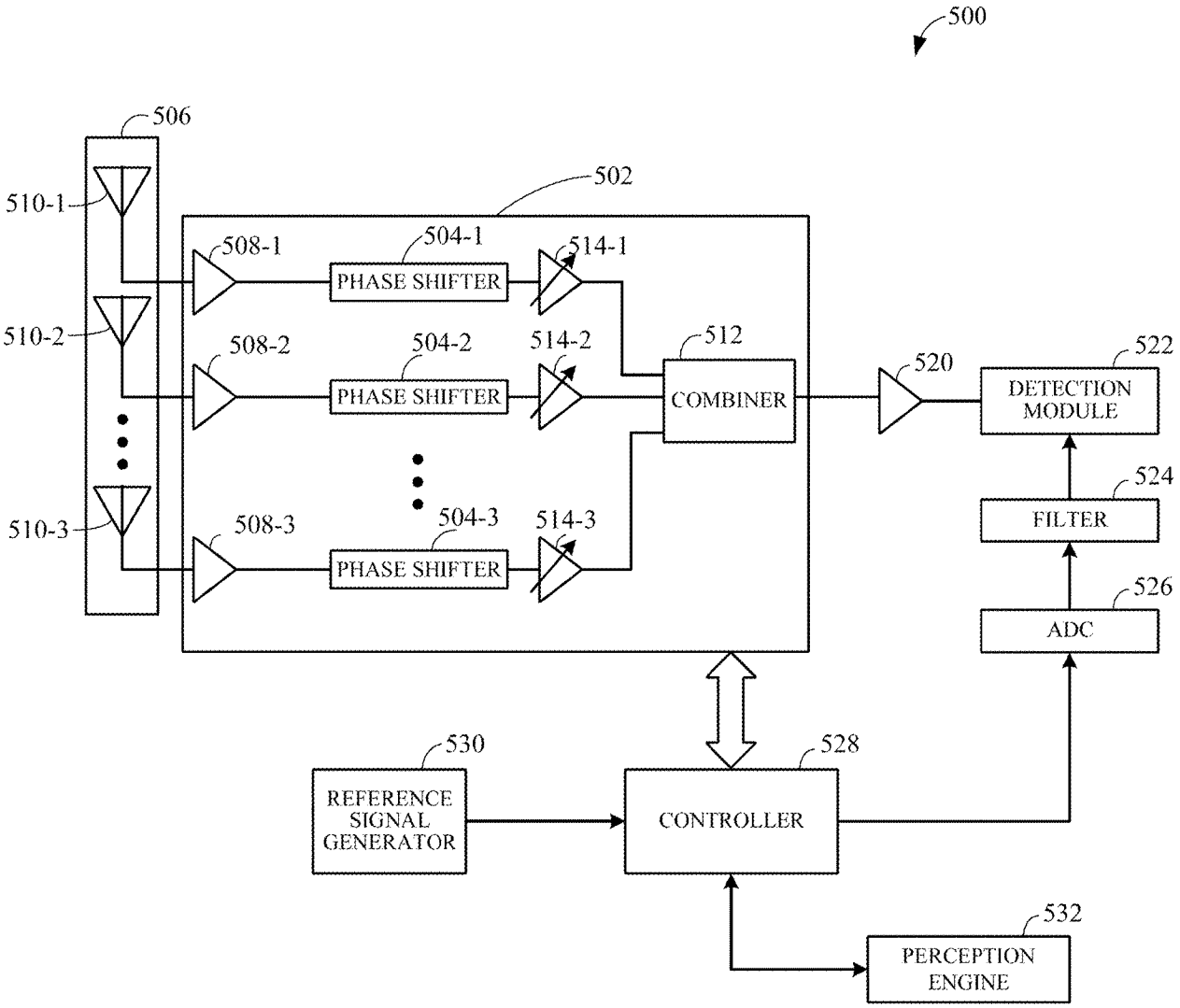
FIG. 5 illustrates a schematic diagram of an antenna system having phase shift elements, according to implementations of the subject technology.

FIG. 5 illustrates a schematic diagram of an antenna system 100 having phase shift elements, according to implementations of the subject technology. The antenna system 500 includes an antenna module 502, an antenna array 506, amplifier 520, detection module 522, filter 524, Analog-to-Digital Converter (ADC) 526, controller 528, reference signal generator 530 and a perception engine 532. The antenna module 502 includes Low Noise Amplifiers (LNAs) 508-1, 508-2, 508-3, phase shifters 504-1, 504-2, 504-3, amplifiers 514-1, 514-2, 514-3, and a combiner 512. The amplifiers 514-1, 514-2, 514-3 may be linear amplifiers in some implementations, or may be Variable Gain Amplifiers (VGAs) in other implementations. The antenna array 506 includes a series of radiating elements 510-1, 510-2, 510-3. Not all of the depicted components may be required, however, and one or more implementations may include additional components not shown in the figure. Variations in the arrangement and type of the components may be made without departing from the scope of the claims as set forth herein. Additional components, different components, or fewer components may be provided.

Each of the radiating elements (e.g., 510-1, 510-2, 510-3) is coupled to a respective phase shifter (e.g., 504-1, 504-2, 504-3) through coupling with a corresponding LNA (e.g., 508-1, 508-2, 508-3) to provide a controllable phase shift of a radio frequency (RF) signal. For example, the radiating element 510-1 is first coupled to the LNA 508-1 that is then coupled to the phase shifter 504-1, the radiating element 510-2 is first coupled to the LNA 508-2 that is then coupled to the phase shifter 504-2, and the radiating element 510-3 is first coupled to the LNA 508-3 that is then coupled to the phase shifter 504-3. The phase shifters 504-1, 504-2, 504-3 at their output are coupled to the amplifiers 514-1, 514-2, 514-3, respectively. The combiner 512 is coupled to the amplifiers 514-1, 514-2, 514-3 and to the amplifier 520. The detection module 522 is coupled to the amplifier 520. The controller 528 is coupled to the reference signal generator 530 and to the perception engine 532. The ADC 526 is coupled to the controller 528 and to the filter 524. In some implementations, both the amplifier 520 and the filter 524 feed into the detection module 522 on separate signal paths. The controller 528 includes a bidirectional connection with the antenna module 502.

The phase shifters 504-1, 504-2, 504-3 change the transmission phase angle in the antenna system 500 by controlling the relative phase of each radiating element in the antenna array 506. As the phase of a signal transmitted from a radiating element indicates the position of a beam form at a point in time on a waveform cycle, the antenna system 500 creates a phase difference between the radiating elements 510-1, 510-2, 510-3, in which the phase is the fraction of the wavelength difference between signals in the range of 0° to 360°. The phase difference identifies a relative displacement between corresponding features of waveforms from different radiating elements having a same frequency. The phase difference may be expressed in degrees or in time, such as between two waves having the same frequency and different phases, thus phase difference. Phase range refers to the phase shift range of an antenna system.

The phase shifters 504-1, 504-2, 504-3 may be implemented as an analog phase shifter in some implementations, or as a digital phase shifter in other implementations. There are different devices that may be used to provide a phase shift in signals, including magnetic, mechanical and electrical; these may use analog signals or digital bits to control the phase shift operation. An analog phase shifter is controlled by voltage level and may provide continuously variable phase changes. Analog phase shifters are considered low loss devices. A digital controller is used to control a digital phase shifter that operates on two-state devices. The digital phase shifters tend to have low noise, uniform performance, wide bandwidth and good linearity.

The illustrated antenna system 500 is a receive path and signals are received at the antenna array 506, aligned in phase by the phase shifters 504-1, 504-2, 504-3, amplified by the amplifiers 514-1, 514-2, 514-3, and combined in the combiner 512. The combiner 512 produces a combined signal 518 that is amplified by the amplifier 520 for detection by the detection module 522. The processing of the combined signal 518 by the detection module 522 may take one of many different forms and include any number of steps, processes and so forth.

The reference signal generator 530 generates a reference signal that is fed to the controller 528. As illustrated, the reference signal generator 530 synchronizes with the transmitted signal. The controller 528 exchanges control signaling with the antenna module 502. The controller 528 may provide controller information to the perception engine 532 and may receive object information from the perception engine 532. The perception engine 532 may include a convolutional neural network or other processing methods for determining information about the environment from received signals. The controller 528 then feeds the controller information to the ADC 526 for digital conversion and to the filter 524 for filtration. The filtered signal from the filter 524 is then fed to the detection module 522 for processing.

There are many different antenna types based on application and requirements. In some aspects, each of the radiating elements 510-1, 510-2, 510-3 in the antenna array 506 includes a series of elements fed by a power-divider that for receive operation has transmission paths from each of the radiating elements 510-1, 510-2, 510-3 to the combiner 512; and for transmit operation has transmission paths from a signal source to each of the radiating elements 510-1, 510-2, 510-3. In some examples, the radiating element may be a single radiating element, such as a patch antenna structure, or otherwise. In some examples, the antenna array 506 may be a matrixed array with a complex corporate feed to each of the individual radiating elements 510-1, 510-2, 510-3 within the matrix. There are many other configurations possible, in which transmission paths to and/or from the antenna array 506 include a phase shifter to change the phase of signals transmitted and/or received at the antenna array.

Figure 6:
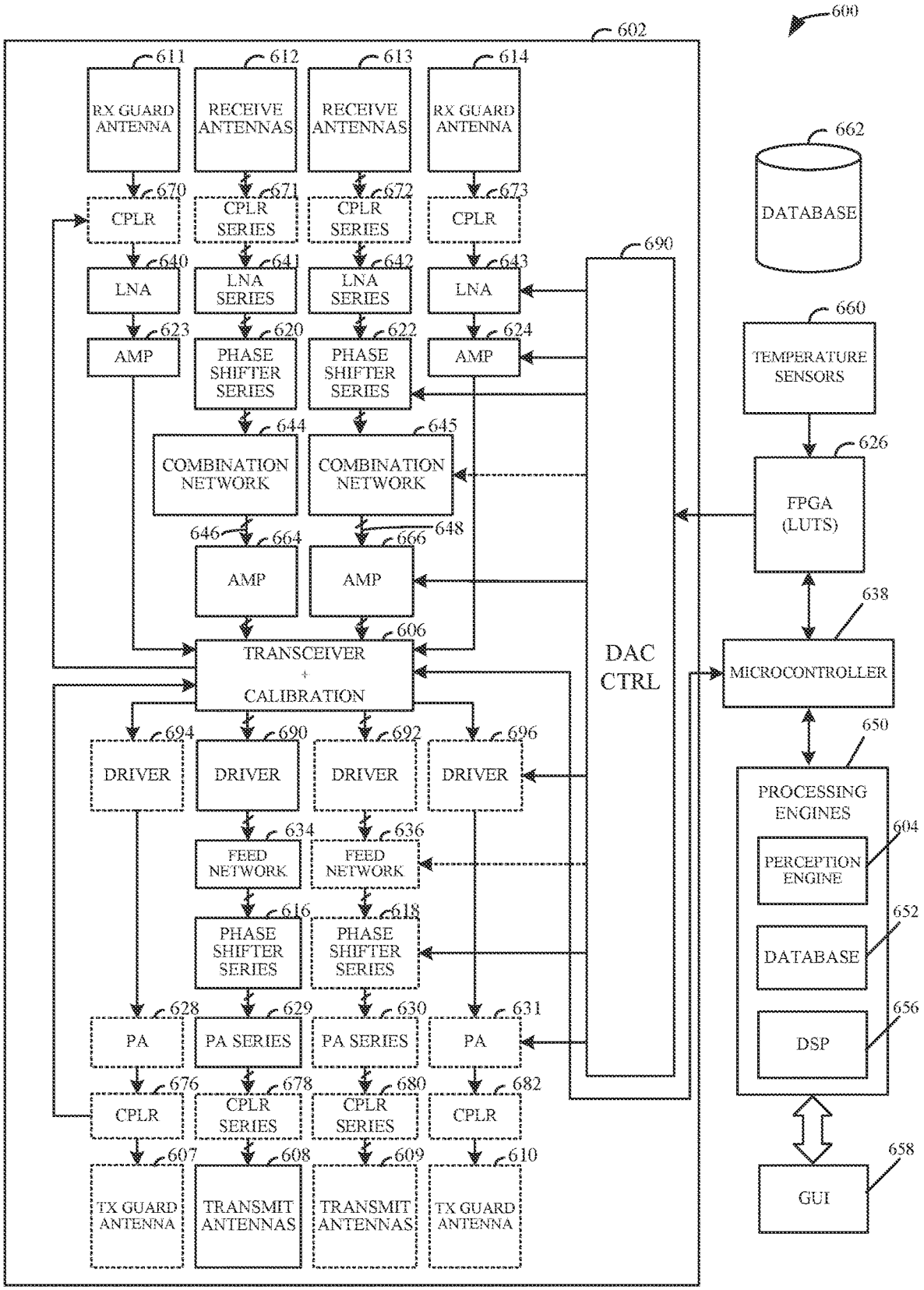
FIG. 6 illustrates a schematic diagram of an example of a radar system, according to implementations of the subject technology.

FIG. 6 illustrates a schematic diagram of a radar system 600 in accordance with various implementations of the subject technology. The radar module 600 includes a radar module 602 that comprises a receive chain and a transmit chain. The receive chain includes receive antennas 612 and 613, receive guard antennas 611 and 614, couplers 670-673, low-noise amplifiers (LNAs) 640-643, phase shifter (PS) circuits 620 and 622, amplifiers 623, 624, 664 and 666, and combination networks 644 and 645. The transmit chain includes drivers 690, 692, 694 and 696, feed networks 634 and 636, PS circuits 616 and 618, power amplifiers 628-631, couplers 676, 678, 680 and 682, transmit antennas 608 and 609, and transmit guard antennas 607 and 610. The radar module 602 also includes a transceiver 606, a digital-to-analog (DAC) controller 690, a Field-Programmable Gate Array (FPGA) 626, a microcontroller 638, processing engines 650, a Graphical User Interface (GUI) 658, temperature sensors 660 and a database 662. The processing engines 650 includes perception engine 604, database 652 and Digital Signal Processor (DSP) 656. Not all of the depicted components may be required, however, and one or more implementations may include additional components not shown in the figure. Variations in the arrangement and type of the components may be made without departing from the scope of the claims as set forth herein. Additional components, different components, or fewer components may be provided.

In some implementations, the electronic device 610 of FIG. 6 may include one or more of the FPGA 626, the microcontroller 638, the processing engines 650, the temperature sensors 660 or the database 662. In some implementations, the electronic device 640 of FIG. 6 is, or includes at least a portion of, the GUI 658.

Radar module 602 is capable of both transmitting RF signals within a FoV and receiving the reflections of the transmitted signals as they reflect from objects in the FoV. With the use of analog beamforming in radar module 602, a single transmit and receive chain can be used effectively to form a directional, as well as a steerable, beam. A transceiver 606 in radar module 602 can generate signals for transmission through a series of transmit antennas 608 and 609 as well as manage signals received through a series of receive antennas 612 and 613. Beam steering within the FoV is implemented with phase shifter (PS) circuits 616 and 618 coupled to the transmit antennas 608 and 609, respectively, on the transmit chain and PS circuits 620 and 622 coupled to the receive antennas 612 and 613, respectively, on the receive chain. Careful phase and amplitude calibration of the transmit antennas 608, 609 and receive antennas 612, 613 can be performed in real-time with the use of couplers integrated into the radar module 602 as described in more detail below. In other implementations, calibration is performed before the radar is deployed in an ego vehicle and the couplers may be removed.

The use of PS circuits 616, 618 and 620, 622 enables separate control of the phase of each element in the transmit antennas 608, 609 and receive antennas 612, 613. Unlike early passive architectures, the beam is steerable not only to discrete angles but to any angle (i.e., from 0° to 660°) within the FoV using active beamforming antennas. A multiple element antenna can be used with an analog beamforming architecture where the individual antenna elements may be combined or divided at the port of the single transmit or receive chain without additional hardware components or individual digital processing for each antenna element. Further, the flexibility of multiple element antennas allows narrow beam width for transmit and receive. The antenna beam width decreases with an increase in the number of antenna elements. A narrow beam improves the directivity of the antenna and provides the radar system 600 with a significantly longer detection range.

The DAC controller 690 is coupled to each of the LNAs 640-643, the amplifiers 623, 624, 664, 666, PS circuits 616, 618, 620, 622, the drivers 690, 692, 694, 696, and the power amplifiers (PAs) 628-631. In some aspects, the DAC controller 690 is coupled to the FPGA 626, and the FPGA 626 can drive digital signaling to the DAC controller 690 to provide analog signaling to the LNAs 640-643, the amplifiers 623, 624, 664, 666, PS circuits 616, 618, 620, 622, the drivers 690, 692, 694, 696, and the PAs 628-631. In some implementations, the DAC controller 690 is coupled to the combination networks 644, 645 and to the feed networks 634, 636.

In various examples, an analog control signal is applied to each PS in the PS circuits 616, 618 and 620, 622 by the DAC controller 690 to generate a given phase shift and provide beam steering. The analog control signals applied to the PSs in PS circuits 616, 618 and 620, 622 are based on voltage values that are stored in Look-up Tables (LUTs) in the FPGA 626. These LUTs are generated by an antenna calibration process that determines which voltages to apply to each PS to generate a given phase shift under each operating condition. Note that the PSs in PS circuits 616, 618 and 620, 622 can generate phase shifts at a very high resolution of less than one degree. This enhanced control over the phase allows the transmit and receive antennas in radar module 602 to steer beams with a very small step size, improving the capability of the radar system 600 to resolve closely located targets at small angular resolution.

In various examples, each of the transmit antennas 608, 609 and the receive antennas 612, 613 may be a meta-structure antenna, a phase array antenna, or any other antenna capable of radiating RF signals in millimeter wave frequencies. A meta-structure, as generally defined herein, is an engineered structure capable of controlling and manipulating incident radiation at a desired direction based on its geometry. Various configurations, shapes, designs and dimensions of the transmit antennas 608, 609 and the receive antennas 612, 613 may be used to implement specific designs and meet specific constraints.

The transmit chain in the radar module 602 starts with the transceiver 606 generating RF signals to prepare for transmission over-the-air by the transmit antennas 608 and 609. The RF signals may be, for example, Frequency-Modulated Continuous Wave (FMCW) signals. An FMCW signal enables the radar system 600 to determine both the range to an object and the object's velocity by measuring the differences in phase or frequency between the transmitted signals and the received/reflected signals or echoes. Within FMCW formats, there are a variety of waveform patterns that may be used, including sinusoidal, triangular, sawtooth, rectangular and so forth, each having advantages and purposes.

Once the FMCW signals are generated by the transceiver 606, the FMCW signals are fed to driver 690. From the driver 690, the signals are divided and distributed through feed network 634, which forms a power divider system to divide an input signal into multiple signals, one for each element of the transmit antennas 608. The feed network 634 may divide the signals so power is equally distributed among them or alternatively, so power is distributed according to another scheme, in which the divided signals do not all receive the same power. Each signal from the feed network 634 is then input to the PS circuit 616, where the FMCW signals are phase shifted based on control signaling from the DAC controller 690 (corresponding to voltages generated by the FPGA 626 under the direction of microcontroller 638), and then transmitted to the PA series 629. The amplified signaling from the PA series 629 is coupled to the transmit antennas 608. Signal amplification is needed for the FMCW signals to reach the long ranges desired for object detection, as the signals attenuate as they radiate by the transmit antennas 608.

In some implementations, the radar system 600 optionally includes multiple transmit chains. For example, a first transmit chain includes driver 690, feed network 634, phase shifter series 616, PA series 629, and transmit antennas 608, and a second transmit chain includes driver 692, feed network 636, phase shifter series 618, PA series 630, and transmit antennas 609. Once the FMCW signals are generated by the transceiver 606, the FMCW signals are fed to drivers 690 and 692. From the drivers 690 and 692, the signals are divided and distributed through feed networks 634 and 636, respectively, which form a power divider system to divide an input signal into multiple signals, one for each element of the transmit antennas 608 and 609, respectively. The feed networks 634 and 636 may divide the signals so power is equally distributed among them or alternatively, so power is distributed according to another scheme, in which the divided signals do not all receive the same power. Each signal from the feed networks 634 and 636 is then input to the PS circuits 616 and 618, respectively, where the FMCW signals are phase shifted based on control signaling from the DAC controller 690 (corresponding to voltages generated by the FPGA 626 under the direction of microcontroller 638), and then transmitted to the PAs 629 and 630. The amplified signaling from PAs 629 and 630 are respectively coupled to the transmit antennas 608 and 609. Signal amplification is needed for the FMCW signals to reach the long ranges desired for object detection, as the signals attenuate as they radiate by the transmit antennas 608 and 609.

In some implementations, the couplers 678 and 680 are optionally coupled to the PAs 629 and 630 for calibration purposes. For example, from the PAs 629 and 630, the FMCW signals are fed to couplers 678 and 680, respectively, to generate calibration signaling that is fed back to the transceiver 606. From the couplers 678 and 680, the FMCW signals are transmitted through transmit antennas 608 and 609 to radiate the outgoing signaling. In some implementations, the PS circuit 616 is coupled to the transmit antennas 608 through the PA 629 and coupler 678, and the PS circuit 618 is coupled to the transmit antennas 609 through the PA 630 and coupler 680.

In some implementations, the transceiver 606 feeds the FMCW signals to drivers 694 and 696, which are then fed to PAs 628 and 632 and to the couplers 676 and 682. In some aspects, the couplers 676 and 682 are coupled between the PAs 628 and 631 for calibration purposes. From these couplers, the FMCW signals are fed to the transmit guard antennas 607 and 610 for side lobe cancelation of the transmission signal. In some aspects, the transmit guard antennas 607 and 610 are optionally coupled to the PAs 628 and 631 and to the drivers 694 and 696.

The microcontroller 638 determines which phase shifts to apply to the PSs in PS circuits 616, 618, 620 and 622 according to a desired scanning mode based on road and environmental scenarios. Microcontroller 638 also determines the scan parameters for the transceiver to apply at its next scan. The scan parameters may be determined at the direction of one of the processing engines 650, such as at the direction of perception engine 604. Depending on the objects detected, the perception engine 604 may instruct the microcontroller 638 to adjust the scan parameters at a next scan to focus on a given area of the FoV or to steer the beams to a different direction.

In various examples and as described in more detail below, radar system 600 operates in one of various modes, including a full scanning mode and a selective scanning mode, among others. In a full scanning mode, the transmit antennas 608, 609 and the receive antennas 612, 613 can scan a complete FoV with small incremental steps. Even though the FoV may be limited by system parameters due to increased side lobes as a function of the steering angle, radar system 600 is able to detect objects over a significant area for a long-range radar. The range of angles to be scanned on either side of boresight as well as the step size between steering angles/phase shifts can be dynamically varied based on the driving environment. To improve performance of an autonomous vehicle (e.g., an ego vehicle) driving through an urban environment, the scan range can be increased to keep monitoring the intersections and curbs to detect vehicles, pedestrians or bicyclists. This wide scan range may deteriorate the frame rate (revisit rate) but is considered acceptable as the urban environment generally involves low velocity driving scenarios. For a high-speed freeway scenario, where the frame rate is critical, a higher frame rate can be maintained by reducing the scan range. In this case, a few degrees of beam scanning on either side of the boresight would suffice for long-range target detection and tracking.

In a selective scanning mode, the radar system 600 scans around an area of interest by steering to a desired angle and then scanning around that angle. This ensures the radar system 600 is to detect objects in the area of interest without wasting any processing or scanning cycles illuminating areas with no valid objects. Since the radar system 600 can detect objects at a long distance, e.g., 300 m or more at boresight, if there is a curve in a road, direct measures do not provide helpful information. Rather, the radar system 600 steers along the curvature of the road and aligns its beams towards the area of interest. In various examples, the selective scanning mode may be implemented by changing the chirp slope of the FMCW signals generated by the transceiver 606 and by shifting the phase of the transmitted signals to the steering angles needed to cover the curvature of the road.

Objects are detected with radar system 600 by reflections or echoes that are received at the receive antennas 612 and 613. In some implementations, the received signaling is fed directly to the LNAs 641 and 642. The LNAs 641 and 642 are positioned between the receive antennas 612 and 613 and PS circuits 620 and 622, which include PSs similar to the PSs in PS circuits 616 and 618. In other implementations, the received signaling is then fed to couplers 672 and 673 using feedback calibration signaling from the transceiver 606. The couplers 670, 672-674 can allow probing to the receive chain signal path during a calibration process. From the couplers 672 and 673, the received signaling is fed to LNAs 641 and 642.

For receive operation, PS circuits 620 and 622 create phase differentials between radiating elements in the receive antennas 612 and 613 to compensate for the time delay of received signals between radiating elements due to spatial configurations. Receive phase-shifting, also referred to as analog beamforming, combines the received signals for aligning echoes to identify the location, or position of a detected object. That is, phase shifting aligns the received signals that arrive at different times at each of the radiating elements in receive antennas 612 and 613. Similar to PS circuits 616, 618 on the transmit chain, PS circuits 620, 622 are controlled by the DAC controller 690, which provides control signaling to each PS to generate the desired phase shift. In some aspects, the FPGA 626 can provide bias voltages to the DAC controller 690 to generate the control signaling to PS circuits 620, 622.

The receive chain then combines the signals fed by the PS circuits 620 and 622 at the combination networks 644 and 645, respectively, from which the combined signals propagate to the amplifiers 664 and 666 for signal amplification. The amplified signal is then fed to the transceiver 606 for receiver processing. Note that as illustrated, the combination networks 644 and 645 can generate multiple combined signals 646 and 648, of which each signal combines signals from a number of elements in the receive antennas 612 and 613, respectively. In one example, the receive antennas 612 and 613 include 128 and 64 radiating elements partitioned into two 64-element and 62-element clusters, respectively. For example, the signaling fed from each cluster is combined in a corresponding combination network (e.g., 644, 645) and delivered to the transceiver 606 in a separate RF transmission line. In this respect, each of the combined signals 646 and 648 can carry two RF signals to the transceiver 606, where each RF signal combines signaling from the 64-element and 62-element clusters of the receive antennas 612 and 613. Other examples may include 8, 26, 64, or 62 elements, and so on, depending on the desired configuration. The higher the number of antenna elements, the narrower the beam width. In some implementations, the combination network 644 is coupled to the receive antennas 612 and the combination network 645 is coupled to receive antennas 613. In some aspects, the receive guard antennas 610 and 614 feed the receiving signaling to couplers 670 and 674, respectively, which are then fed to LNAs 640 and 643. The filtered signals from the LNAs 640 and 643 are fed to amplifiers 623 and 624, respectively, which are then fed to the transceiver 606 for side lobe cancelation of the received signals by the receiver processing.

In some implementations, the radar module 602 includes receive guard antennas 610 and 614 that generate a radiation pattern separate from the main beams received by the 64-element receive antennas 612 and 613. The receive guard antennas 610 and 614 are implemented to effectively eliminate side-lobe returns from objects. The goal is for the receive guard antennas 610 and 614 to provide a gain that is higher than the side lobes and therefore enable their elimination or reduce their presence significantly. The receive guard antennas 610 and 614 effectively act as a side lobe filter. Similar, the radar module 602 includes transmit guard antennas 607 and 610 to eliminate side lobe formation or reduce the gain generated by transmitter side lobes at the time of a transmitter main beam formation by the transmit antennas 608 and 609.

Once the received signals are received by transceiver 606, the received signals are processed by processing engines 650. Processing engines 650 include perception engine 604 that detects and identifies objects in the received signal with one or more neural networks using machine learning or computer vision techniques, database 652 to store historical and other information for radar system 600, and the DSP engine 654 with an Analog-to-Digital Converter (ADC)

module to convert the analog signals from transceiver 606 into digital signals that can be processed by the monopulse module 657 to determine AoA information for the localization, detection and identification of objects by perception engine 604. In one or more implementations, DSP engine 656 may be integrated with the microcontroller 638 or the transceiver 606.

Radar system 600 also includes a Graphical User Interface (GUI) 658 to enable configuration of scan parameters such as the total angle of the scanned area defining the FoV, the beam width or the scan angle of each incremental transmission beam, the number of chirps in the radar signal, the chirp time, the chirp slope, the chirp segment time, and so on as desired. In some implementations, the GUI 658 can provide for display a rendering of roadmap data that indicates range, velocity and AoA information for detected objects in the FoV. In some examples, the roadmap data can delineate between traffic moving toward the radar system 600 and traffic moving away (or receding from) the radar system 600 using a predetermined angular resolution (e.g., at or less than 1.6°) with angular precision based at least on the monopulse and/or guard channel detection techniques. In addition, radar system 600 has a temperature sensor 660 for sensing the temperature around the vehicle so that the proper voltages from FPGA 626 may be used to generate the desired phase shifts. The voltages stored in FPGA 626 are determined during calibration of the antennas under different operating conditions, including temperature conditions. A database 662 may also be used in radar system 600 to store radar and other useful data.

The radar data may be organized in sets of Range-Doppler (RD) map information, corresponding to four-dimensional (4D) information that is determined by each RF beam reflected from targets, such as azimuthal angles, elevation angles, range, and velocity. The RD maps may be extracted from FMCW radar signals and may contain both noise and systematic artifacts from Fourier analysis of the radar signals. The perception engine 604 controls further operation of the transmit antennas 608 and 609 by, for example, providing an antenna control signal containing beam parameters for the next RF beams to be radiated from cells in the transmit antennas 608.

In operation, the microcontroller 638 is responsible for directing the transmit antennas 608 and 609 to generate RF beams with determined parameters such as beam width, transmit angle, and so on. The microcontroller 638 may, for example, determine the parameters at the direction of perception engine 604, which may at any given time determine to focus on a specific area of a FoV upon identifying targets of interest in the ego vehicle's path or surrounding environment. The microcontroller 638 determines the direction, power, and other parameters of the RF beams and controls the transmit antennas 608 and 609 to achieve beam steering in various directions. The microcontroller 638 also determines a voltage matrix to apply to reactance control mechanisms coupled to the transmit antennas 608 and 609 to achieve a given phase shift. In some examples, the transmit antennas 608 and 609 are adapted to transmit a directional beam through active control of the reactance parameters of the individual cells that make up the transmit antennas 608 and 609.

Next, the transmit antennas 608 and 609 radiate RF beams having the determined parameters. The RF beams are reflected from targets in and around the ego vehicle's path (e.g., in a 660° field of view) and are received by the transceiver 606. The receive antennas 612 and 613 send the received 4D radar data to the perception engine 604 for target identification.

In various examples, the perception engine 604 can store information that describes an FoV. This information may be historical data used to track trends and anticipate behaviors and traffic conditions or may be instantaneous or real-time data that describes the FoV at a moment in time or over a window in time. The ability to store this data enables the perception engine 604 to make decisions that are strategically targeted at a particular point or area within the FoV. For example, the FoV may be clear (e.g., no echoes received) for a period of time (e.g., five minutes), and then one echo arrives from a specific region in the FoV; this is similar to detecting the front of a car. In response, the perception engine 604 may determine to narrow the beam width for a more focused view of that sector or area in the FoV. The next scan may indicate the targets' length or other dimension, and if the target is a vehicle, the perception engine 604 may consider what direction the target is moving and focus the beams on that area. Similarly, the echo may be from a spurious target, such as a bird, which is small and moving quickly out of the path of the vehicle. The database 652 coupled to the perception engine 604 can store useful data for radar system 600, such as, for example, information on which subarrays of the transmit antennas 608 and 609 perform better under different conditions.

In various examples described herein, the use of radar system 600 in an autonomous driving vehicle provides a reliable way to detect targets in difficult weather conditions. For example, historically a driver will slow down dramatically in thick fog, as the driving speed decreases along with decreases in visibility. On a highway in Europe, for example, where the speed limit is 515 km/h, a driver may need to slow down to 50 km/h when visibility is poor. Using the radar system 600, the driver (or driverless vehicle) may maintain the maximum safe speed without regard to the weather conditions. Even if other drivers slow down, a vehicle enabled with the radar system 600 can detect those slow-moving vehicles and obstacles in its path and avoid/navigate around them.

Additionally, in highly congested areas, it is necessary for an autonomous vehicle to detect targets in sufficient time to react and take action. The examples provided herein for a radar system increase the sweep time of a radar signal to detect any echoes in time to react. In rural areas and other areas with few obstacles during travel, the perception engine 604 adjusts the focus of the RF beam to a larger beam width, thereby enabling a faster scan of areas where there are few echoes. The perception engine 604 may detect this situation by evaluating the number of echoes received within a given time period and making beam size adjustments accordingly. Once a target is detected, the perception engine 604 determines how to adjust the beam focus. This is achieved by changing the specific configurations and conditions of the transmit antennas 608. In one example scenario, a subset of unit cells is configured as a subarray. This configuration means that this set may be treated as a single unit, and all the cells within the subarray are adjusted similarly. In another scenario, the subarray is changed to include a different number of unit cells, where the combination of unit cells in a subarray may be changed dynamically to adjust to conditions and operation of the radar system 600.

All of these detection scenarios, analysis and reactions may be stored in the perception engine 604, such as in the database 652, and used for later analysis or simplified reactions. For example, if there is an increase in the echoes received at a given time of day or on a specific highway, that information is fed into the microcontroller 638 to assist in proactive preparation and configuration of the transmit antennas 608 and 609. Additionally, there may be some subarray combinations that perform better, such as to achieve a desired result, and this is stored in the database 652.

Figure 7:
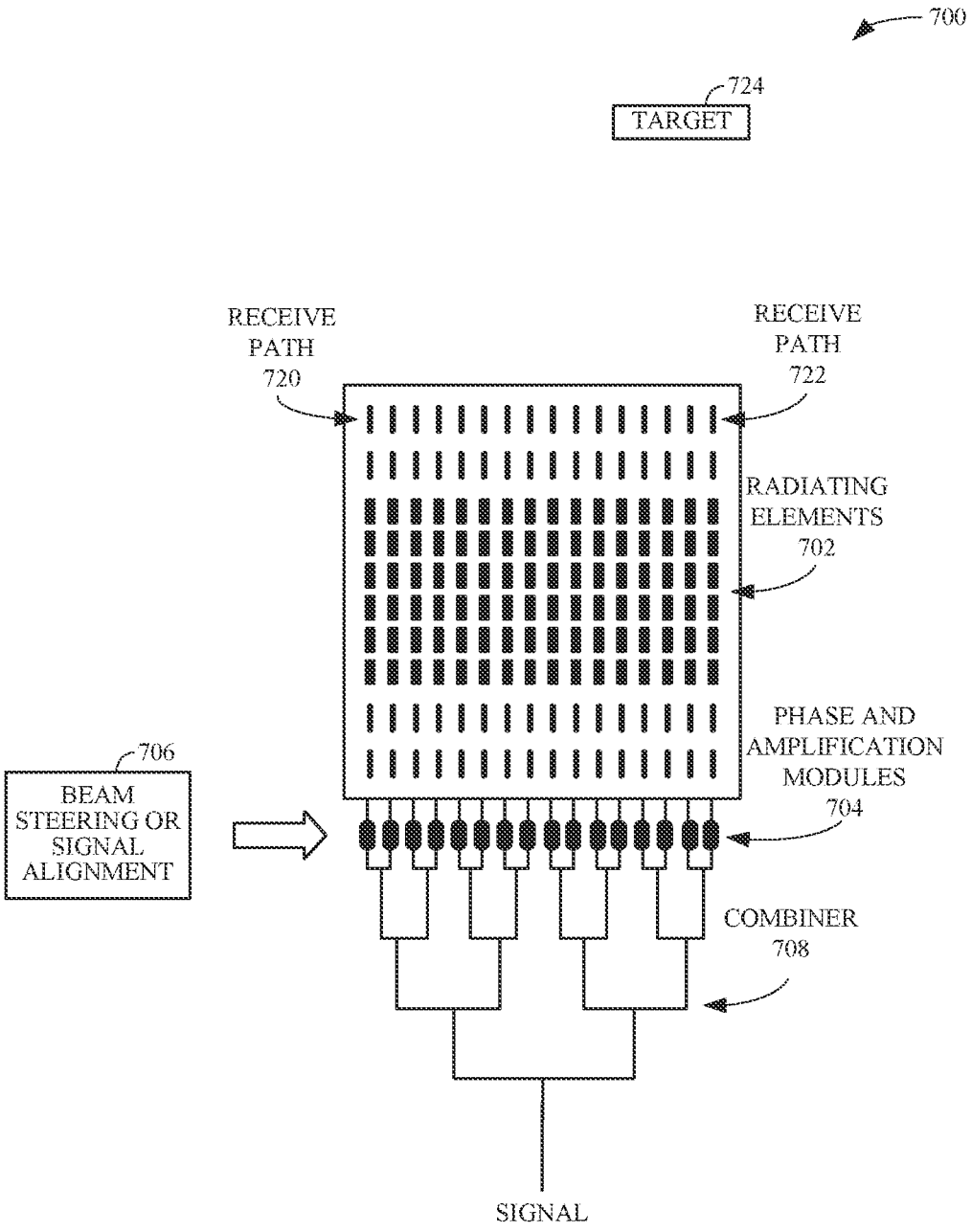
FIG. 7 illustrates a schematic diagram of a portion of an antenna system, according to implementations of the subject technology.

FIG. 7 illustrates a schematic diagram of a portion of an antenna structure 700, according to implementations of the subject technology. The receive antennas 612 and 613 of FIG. 6 are illustrated for the receive antenna in more detail in FIG. 7, as the antenna structure 700. The antenna structure 700 includes radiating elements 702, phase and amplification modules 704 and a combiner 708. The phase and amplification modules 704 are coupled between the radiating elements 702 and the combiner 708. The radiating elements 702 can form multiple paths for signals to propagate through the phase and amplification modules 704 to the combiner 708, resulting in a single return signal. The radiating elements 702 include receive paths 720 and 722, each of which can receive a respective return signal that is a reflection from a target 724 at slightly different times.

In some implementations, the phase and amplification modules 704 include phase shift elements, amplification elements, and LNA elements for receive operation and PA for transmit operation. The phase and amplification modules 704 provide phase shifting to align the received return signals in time. Each receive path is applied with a different phase shift by the phase and amplification modules 704 controlled by a beam-steering or signal alignment module 706. In some aspects, the beam-steering control is applied for transmit operations and the signal alignment is applied for receive operations.

Figure 8:
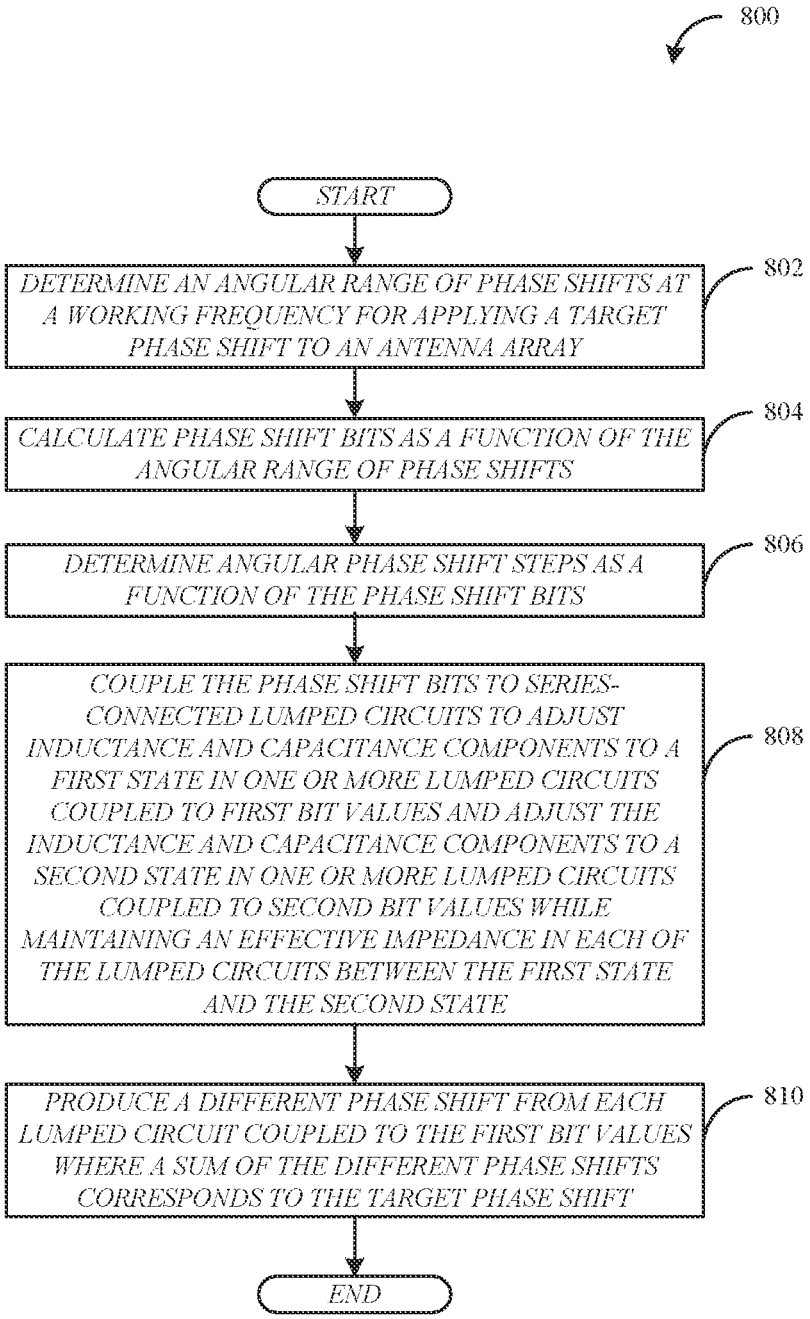
FIG. 8 illustrates a flow chart of an example process for designing a phase shifting mechanism, according to implementations of the subject technology.

FIG. 8 illustrates a flow chart of an example process 800 for designing a phase shifting mechanism, according to implementations of the subject technology. For explanatory purposes, the example process 800 is primarily described herein with reference to FIGS. 2A-2D, 3A, 4A and 4B. Further for explanatory purposes, the blocks of the example process 800 are described herein as occurring in serial, or linearly. However, multiple blocks of the example process 800 can occur in parallel. In addition, the blocks of the example process 800 can be performed in a different order than the order shown and/or one or more of the blocks of the example process 800 are not performed.

The process 800 begins at step 802, where angular range of phase shifts at a working frequency are determined for applying a target phase shift to an antenna array. For example, the angular range of phase shifts may include a range of 0° to 360°. Next, at step 804, phase shift bits are calculated as a function of the angular range of phase shifts. Subsequently, at step 806, angular phase shift steps are determined as a function of the phase shift bits. For example, the angular phase shift steps may be defined as $$\frac{360^\circ}{2^N},$$

and where N is the number of phase shift bits. Next, at step 808, the phase shift bits are coupled to series-connected lumped circuits to adjust inductance and capacitance components to a first state in one or more lumped circuits coupled to first bit values and to adjust the inductance and capacitance components to a second state in or more lumped circuits coupled to second bit values while maintaining an effective impedance in each of the lumped circuits between the first state and the second state. Subsequently, at step 810, a different phase shift is produced from each lumped circuit coupled to the first bit values where a sum of the different phase shifts corresponds to the target phase shift.

It is also appreciated that the previous description of the disclosed examples is provided to enable any person skilled in the art to make or use the present disclosure. Various modifications to these examples will be readily apparent to those skilled in the art, and the generic principles defined herein may be applied to other examples without departing from the spirit or scope of the disclosure. Thus, the present disclosure is not intended to be limited to the examples shown herein but is to be accorded the widest scope consistent with the principles and novel features disclosed herein.

As used herein, the phrase "at least one of" preceding a series of items, with the terms "and" or "or" to separate any of the items, modifies the list as a whole, rather than each member of the list (i.e., each item). The phrase "at least one of" does not require selection of at least one item; rather, the phrase allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

Furthermore, to the extent that the term "include," "have," or the like is used in the description or the claims, such term is intended to be inclusive in a manner similar to the term "comprise" as "comprise" is interpreted when employed as a transitional word in a claim.

A reference to an element in the singular is not intended to mean "one and only one" unless specifically stated, but rather "one or more." The term "some" refers to one or more. Underlined and/or italicized headings and subheadings are used for convenience only, do not limit the subject technology, and are not referred to in connection with the interpretation of the description of the subject technology. All structural and functional equivalents to the elements of the various configurations described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

While this specification contains many specifics, these should not be construed as limitations on the scope of what may be claimed, but rather as descriptions of particular implementations of the subject matter. Certain features that are described in this specification in the context of separate implementations can also be implemented in combination in a single implementation. Conversely, various features that are described in the context of a single implementation can also be implemented in multiple implementations separately or in any suitable sub combination. Moreover, although features may be described above as acting in certain combinations and even initially claimed as such, one or more features from a claimed combination can in some cases be excised from the combination, and the claimed combination may be directed to a sub combination or variation of a sub combination.

The subject matter of this specification has been described in terms of particular aspects, but other aspects can be implemented and are within the scope of the following claims. For example, while operations are depicted in the drawings in a particular order, this should not be understood as requiring that such operations be performed in the particular order shown or in sequential order, or that all illustrated operations be performed, to achieve desirable results. The actions recited in the claims can be performed in a different order and still achieve desirable results. As one example, the processes depicted in the accompanying figures do not necessarily require the particular order shown, or sequential order, to achieve desirable results. Moreover, the separation of various system components in the aspects described above should not be understood as requiring such separation in all aspects, and it should be understood that the described program components and systems can generally be integrated together in a single hardware product or packaged into multiple hardware products. Other variations are within the scope of the following claim.

What is claimed is:

1. A radar device, comprising:

an antenna array;

a transceiver coupled to the antenna array;

an antenna controller adapted to steer radiation beams from the antenna array; and a phase shift device, comprising:

a variable inductor element configured to toggle between a first inductance state and a second inductance state in response to a first control bit value; and a plurality of variable capacitor elements coupled to the variable inductor element and configured to toggle between a first capacitance state and a second capacitance state in response to a second control bit value different from the first control bit value, wherein the variable inductor element and the plurality of variable capacitor elements collectively produce a first phase shift using the first inductance state and the first capacitance state and collectively produce a second phase shift using the second inductance state and the second capacitance state, wherein a target phase shift is produced from a difference between the first phase shift and the second phase shift.

2. The radar device of claim 1, wherein the first phase shift corresponds to a first steering direction and the second phase shift corresponds to a second steering direction.

3. The radar device of claim 2, wherein the variable inductor element comprises a transformer and a first switch coupled to the transformer, wherein the transformer produces the first inductance state when the first switch is open, and wherein the transformer produces the second inductance state when the first switch is closed.

4. The radar device of claim 3, wherein each of the plurality of variable capacitor elements comprises a first capacitor coupled in series with a second switch and a second capacitor coupled in parallel to the first capacitor and the second switch.

5. The phase shift device of claim 4, wherein the first capacitor and the second capacitor collectively produce the first capacitance state when the second switch is closed and the first switch is open.

6. The phase shift device of claim 4, wherein the first capacitor and the second capacitor collectively produce the second capacitance state when the second switch is open and the first switch is closed.

7. The radar device of claim 3, wherein each of the plurality of variable capacitor elements comprises a first capacitor coupled in series with a second switch.

8. The radar device of claim 7, wherein the first capacitor produces the first capacitance state when the second switch is closed and the first switch is open.

9. The radar device of claim 7, wherein the first capacitor produces the second capacitance state when the second switch is open and the first switch is closed.

10. The radar device of claim 2, wherein the variable inductor element comprises a transformer and a variable capacitor coupled to the transformer, wherein the transformer produces the first inductance state when the variable capacitor is applied with a first voltage, and wherein the transformer produces the second inductance state when the variable capacitor is applied with a second voltage different from the first voltage.

11. A beamsteering antenna system, comprising:

an array of radiating elements; and a beamsteering controller coupled to the array of radiating elements and configured to apply phase shifting to transmit signaling directed to the array of radiating elements for a transmit operation and to return signaling from the array of radiating elements for a receive operation, the phase shift array comprising:

a plurality of phase shift circuits connected in series, each of the plurality of phase shift circuits comprising a lumped circuit with variable inductance and variable capacitance; and a control mechanism coupled to the plurality of phase shift circuits and configured to control each of the plurality of phase shift circuits.

12. The beamsteering antenna system of claim 11, wherein the beamsteering controller steers transmission signals in a specific direction having an azimuth angle and elevation angle with respect to boresight.

13. The beamsteering antenna system of claim 11, wherein the lumped circuit comprises:

a variable inductor element configured to toggle between a first inductance state and a second inductance state in response to a first control bit value applied with the control mechanism; and a plurality of variable capacitor elements coupled to the variable inductor element and configured to toggle between a first capacitance state and a second capacitance state in response to a second control bit value applied with the control mechanism, the second control bit value being different from the first control bit value, wherein the variable inductor element and the plurality of variable capacitor elements collectively produce a first phase shift using the first inductance state and the first capacitance state and collectively produce a second phase shift using the second inductance state and the second capacitance state, wherein a target phase shift is produced from a difference between the first phase shift and the second phase shift.

14. The beamsteering antenna system of claim 11, wherein the variable inductor element comprises a transformer and a first switch coupled to the transformer, wherein the transformer produces the first inductance state when the first switch is open, and wherein the transformer produces the second inductance state when the first switch is closed.

15. The beamsteering antenna system of claim 14, wherein each of the plurality of variable capacitor elements comprises a first capacitor coupled in series with a second switch and a second capacitor coupled in parallel to the first capacitor and the second switch.

16. The beamsteering antenna system of claim 15, wherein the first capacitor and the second capacitor collectively produce the first capacitance state when the second switch is closed and the first switch is open.

17. The beamsteering antenna system of claim 16, wherein the first capacitor and the second capacitor collectively produce the second capacitance state when the second switch is open and the first switch is closed.

18. The beamsteering antenna system of claim 17, wherein each of the plurality of variable capacitor elements comprises a first capacitor coupled in series with a second switch.

19. The beamsteering antenna system of claim 18, wherein the first capacitor produces the first capacitance state when the second switch is closed and the first switch is open.

20. The beamsteering antenna system of claim 19, wherein the first capacitor produces the second capacitance state when the second switch is open and the first switch is closed.

* * * * *